US006105791A

United States Patent [19]

Chalson et al.

[11] Patent Number: 6,105,791

[45] Date of Patent: Aug. 22, 2000

[54] INVENTORY COUNTING ARTICLE PUSHER DISPLAY TRAY SYSTEM

[75] Inventors: Jay Chalson, Hartsdale; Anthony Camello, Brooklyn, both of N.Y.

[73] Assignee: Display Technologies, LLC, College Point, N.Y.

[21] Appl. No.: 09/299,847

[22] Filed: Apr. 26, 1999

[51] Int. Cl.[7] ..... A47F 1/04

[52] U.S. Cl. ..... 211/59.3

[58] Field of Search ..... 211/59.2, 59.3; D6/408; 312/71; 221/2, 4, 7, 8; 359/882

[56] References Cited

U.S. PATENT DOCUMENTS

| | | | |
|---|---|---|---|
| 2,738,881 | 3/1956 | Michel | 211/59.3 |
| 3,004,474 | 10/1961 | Hund | 88/97 |
| 3,270,915 | 9/1966 | Auer | 221/2 |
| 3,308,961 | 3/1967 | Chesley | 211/59.3 |
| 3,436,136 | 4/1969 | McKechnie | 312/71 |
| 3,724,715 | 4/1973 | Auriemma | 312/71 X |
| 4,742,936 | 5/1988 | Rein | 211/59.3 X |
| 4,836,390 | 6/1989 | Polvere . | |
| 4,907,707 | 3/1990 | Crum . | |
| 4,984,709 | 1/1991 | Weinstein | 221/7 |
| 5,069,349 | 12/1991 | Wear et al. | 211/59.3 |
| 5,240,126 | 8/1993 | Foster et al. | 211/59.3 |
| 5,366,099 | 11/1994 | Schmid | 211/59.3 |
| 5,413,229 | 5/1995 | Zuberbuhler et al. . | |
| 5,562,217 | 10/1996 | Salveson et al. . | |
| 5,634,564 | 6/1997 | Spanner et al. . | |
| 5,685,664 | 11/1997 | Parham et al. | 211/59.3 X |
| 5,959,792 | 9/1999 | Ibrahim | 359/882 X |
| 5,992,652 | 11/1999 | Springs | 211/59.3 |

*Primary Examiner*—Daniel P. Stodola
*Assistant Examiner*—Richard M. Smith
*Attorney, Agent, or Firm*—Amster, Rothstein & Ebenstein

[57] ABSTRACT

An inventory counting article pusher display tray system includes an elongate track having a front end, a rear wall, and a floor for positioning a row of articles thereon for movement along the track. The track further defines a series of longitudinally spaced numbers visible from above the track and extending rearwardly from the track front end, for indicating the number of articles in or removed from the row. A pusher is connected to the track for movement therealong and has a front side for engagement with a rearmost article on the track. A spring urges the pusher toward the track end of said track so as to move all articles on the track toward the track front. A reflective panel is secured to the pusher for movement as a unit along the floor, the reflective panel being disposed below the floor and angled relative to the floor so as to project substantially forwardly one of the numbers reflecting the position of the pusher along the track.

13 Claims, 7 Drawing Sheets

INVENTORY COUNTING ARTICLE PUSHER DISPLAY TRAY SYSTEM

BACKGROUND OF THE INVENTION

The present invention relates to a display tray with an article pusher system, and more particularly to such a display tray which provides a running count of the number of articles within a channel of the display tray.

U.S. Pat. No. 5,413,229 is directed to a shelf allocation and management system. The display channel has a puller member on which markings are provided to indicate the amount of space remaining in the shelf when the products are manually advanced to the front of the channel using the puller member. The puller member provides an accurate indication of the inventory in the channel only immediately after it has been manually pulled forward so that all of the product stretches backwardly from the front of the shelf. As the puller member is not biased towards the front of the channel, it may remain stationary as successive products are taken out of the channel from the front thereof until such time as it is manually pulled forwardly by the user. Thus the inventory count is not just simply read from the system, but must be accompanied by a manual urging of the pusher member forwardly.

Further, while the '229 Patent teaches that markings may be disposed on the puller member to indicate the amount of space remaining on the shelf when the products are advanced to the front as an aid for restocking purposes, it is unclear whether or not numerals are associated with the various markings. In any case, the markings or numbers, if any, are readable only from above the tray (that is, at an upwardly extending angle to the horizontal). Indeed, depending upon the height of the products in the channel, it may be impossible to read the markings except from a position substantially higher than the channel bottom. Such an angle of viewing may not be available when the tray is disposed between two closely vertically spaced shelves. In any case, it would be much simpler to perform inventory if the markings could simply be read from the front of the channel.

It is also known to use a conventional tray pusher inventory counting system wherein the numbers are printed on the biasing means (typically a helically wound spring). However in such a device the numbers are difficult to read because they are typically not flat, and the numbers tend to wear out rapidly since they are undergoing flexing every time a product is removed from or inserted into the channel. Additionally, in this system the same problem of the angle of viewing exists as with the system of the '229 Patent.

Accordingly, it is an object of the present invention to provide in an article pusher display tray an inventory counting system wherein the number of products in a channel is evidenced at all times, without requiring any manual operation on the system by a user.

Another object is to provide such a system wherein the markings are disposed flat on a rigid surface.

A further object is to provide such a system wherein the markings may be easily read from one end of the channel (preferably the front of the channel) along a generally horizontal line of sight.

It is also an object of the present invention to provide such a system which is inexpensive and simple to manufacture, use and maintain.

SUMMARY OF THE INVENTION

It has now been found that the above and related objects of the present invention are obtained in an inventory counting article pusher display tray system according to the present invention. The system comprises an elongate track having a front end and a rear wall and including a floor for positioning a row of articles thereon for movement along the track. The track further defines a series of longitudinally spaced numbers visible from above the track and extending rearwardly from the track front end for indicating the number of articles in or removed from the row. A pusher is connected to the track for movement therealong and has a front sided for engagement with a rearmost article on the track. Spring means urge the pusher toward the track front end so as to move all articles on the track toward the track front end. A reflective panel is secured to the pusher for movement as a unit along the floor. The reflective panel is disposed below the floor and angled relative to the floor so as to project substantially towards one of the track front end and the track rear wall (preferably forwardly) one of the numbers reflecting the position of the pusher along the track.

Preferably the spring means is a self-coiling spring comprising a strip of spring material wound at least partially to form a coiled portion defining a coil axis, the coil being arranged such that the coiled portion is extended as the pusher is moved toward the track rear end.

In a preferred embodiment, each of the numbers defined by track is flat and inflexible. The series of numbers defined by the track lies in a horizontal plane and is disposed on a downwardly facing surface of the floor. Preferably, the floor has a transparent portion with a series of opaque numbers disposed thereon at regular horizontal intervals, corresponding to the thickness of an article, and optionally running sequentially in ascending order from the track front end to the track rear wall such that the projected one number indicates the number of articles remaining on the track.

The reflective panel optimally forms a 45° angle with the plane. The floor is substantially rigid, and the series of numbers is disposed in a substantially horizontal row, preferably along a bottom of the floor. The reflective panel projects (reflects) the one number immediately thereabove forwardly such that the projected one number is visible from the track front end. The reflective panel is substantially rigidly secured to the pusher for travel therewith as a unit.

BRIEF DESCRIPTION OF THE DRAWING

The above and related objects, features and advantages of the present invention will be more fully understood by reference to the following detailed description of the presently preferred, albeit illustrative, embodiments of the present invention when taken in conjunction with the accompanying drawing wherein.

DETAILED DESCRIPTION OF THE PREFERRED EMBODIMENTS

Figure 1:
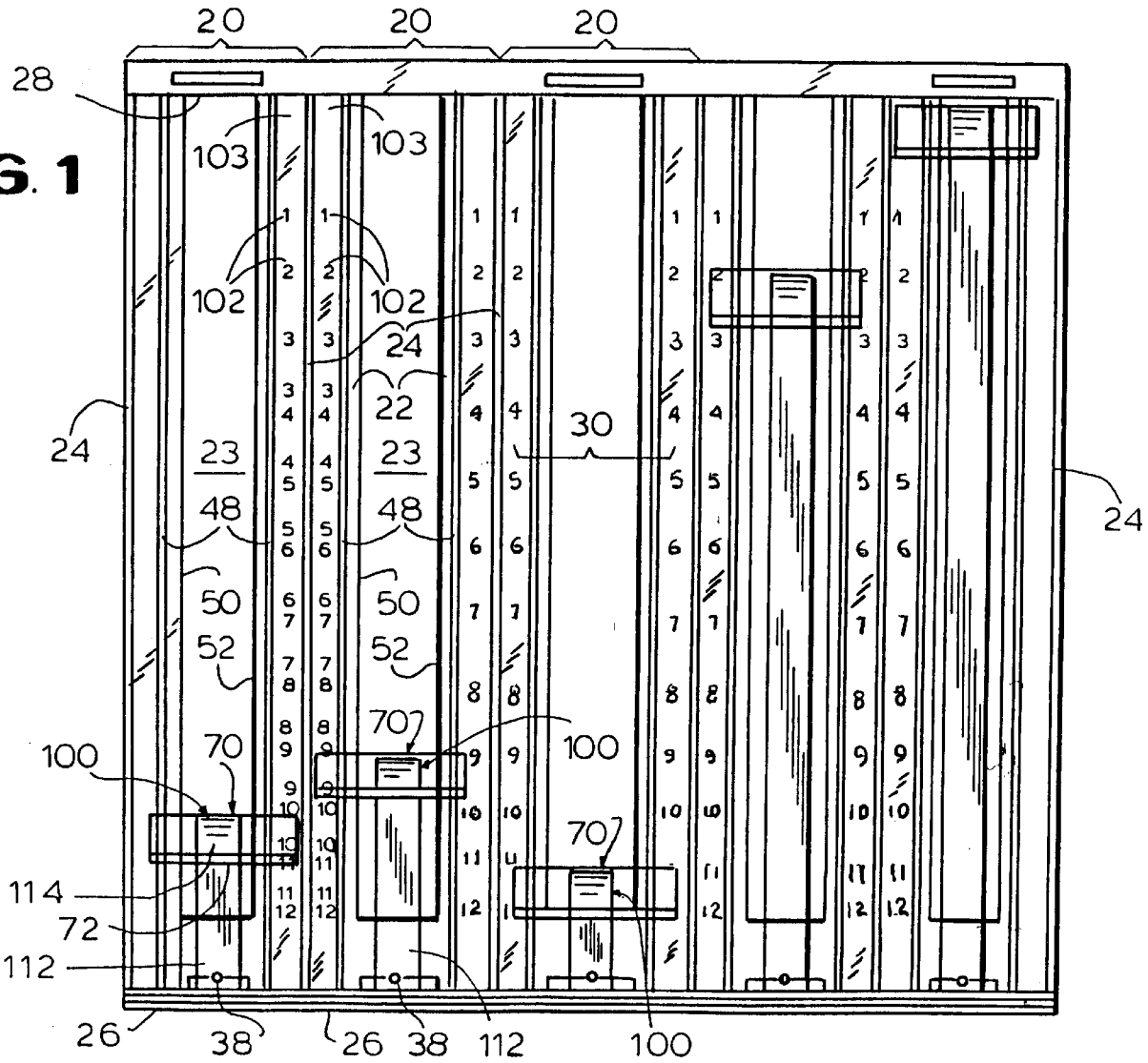
FIG. 1 is a top plan view of a multi-track display tray system according to the present invention.

Referring now to the drawing, and in particular to FIG. 1 thereof, therein illustrated is a multi-track, spring-driven, article-pusher display tray device according to the present invention, generally designated by the reference numeral 10. The tray 10 is designed to merchandise articles C such as bottled, canned or packaged drink, food or cosmetic products. The device 10 includes at least one elongate track 20, and preferably a plurality of interconnected (and optionally detachably interconnected) elongate, parallel tracks 20. A pusher or slider, generally designated 70, is connected to each track 20 for sliding movement along the length of the respective track 20. A spring, generally designated 100, is provided for each track 20 so as to urge the respective pusher 70 forwardly on the respective track 20 toward the respective front wall 26.

The tracks 20 are interconnected in a side-by-side relationship in a manner such that the size of the entire device 10 is suitable for placement onto an existing display shelf (not shown) in a retail store in which the device is desired to be installed. Releasable interconnection of two adjacent tracks 20 may be achieved by conventional connecting means (not shown).

Figure 2:
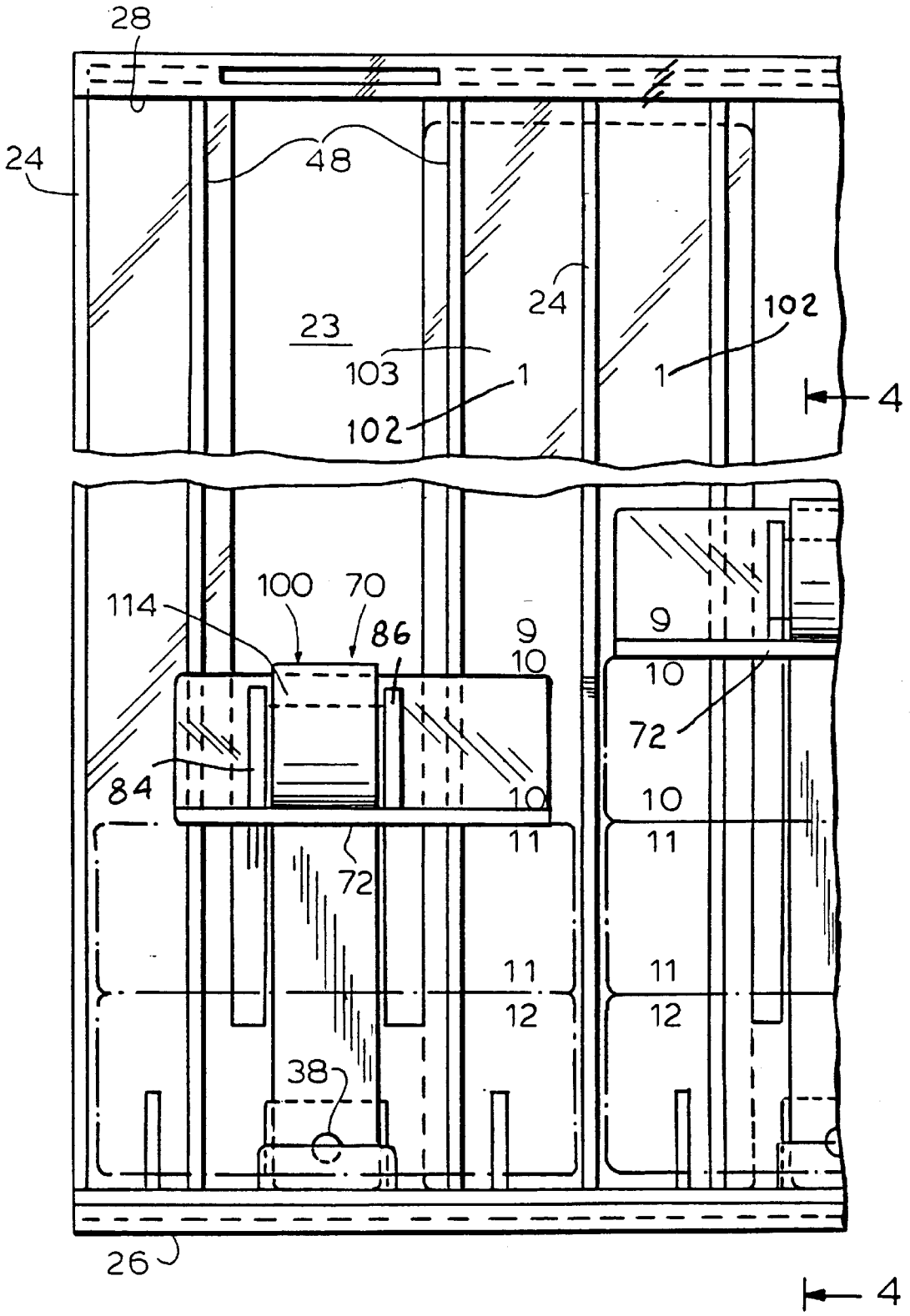
FIG. 2 is a fragmentary top plan view thereof, to an enlarged scale.
Figure 3:
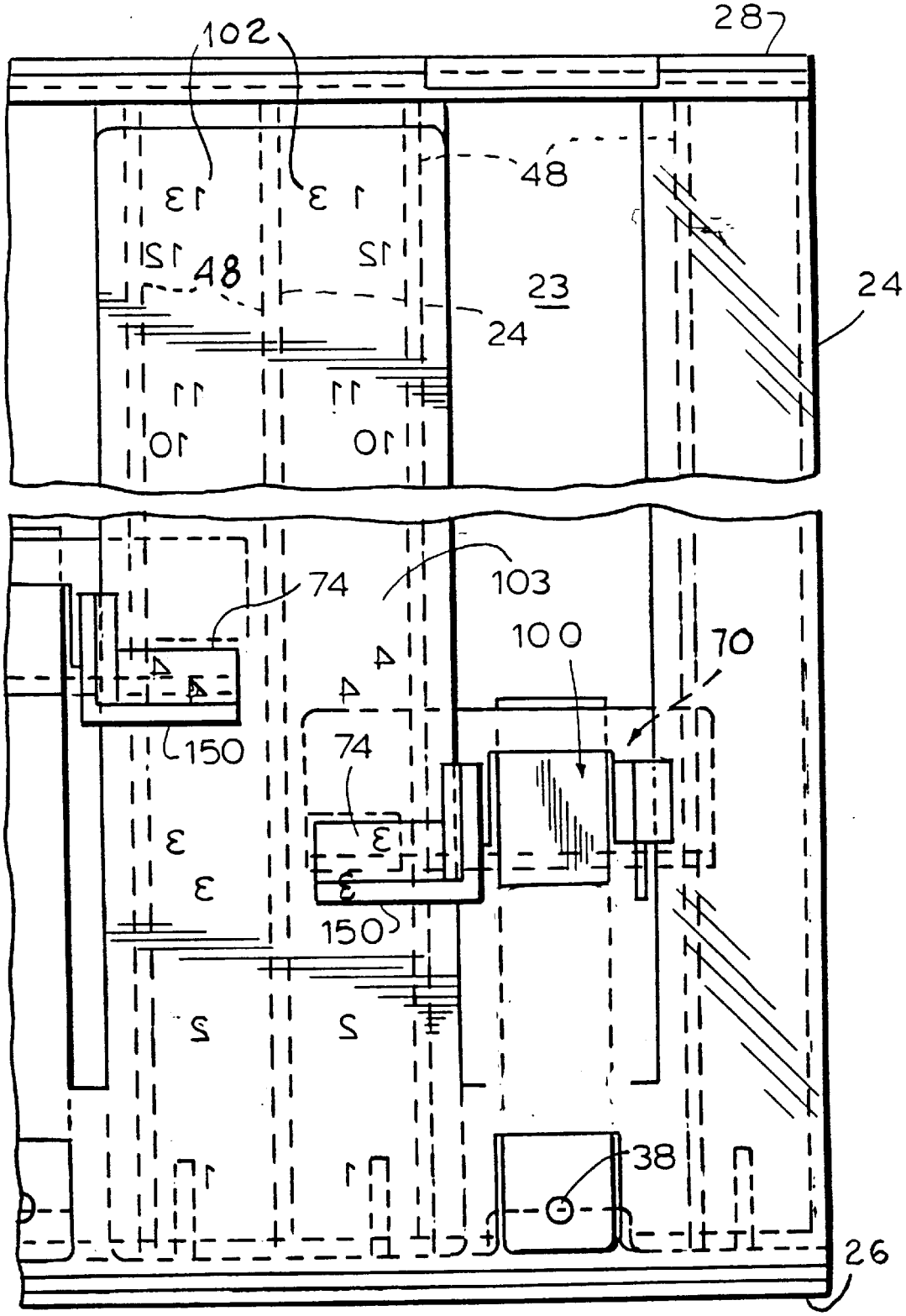
FIG. 3 is a fragmentary bottom plane view thereof, to an enlarged scale.

Each track 20 is preferably a one-piece construction formed of molded plastic material and includes, as best illustrated in FIG. 2, an elongate floor 22, a pair of opposed sidewalls 24, and front and rear opposed walls 26 and 28. A sidewall 24 is formed along each of the side edges of the floor 22 and extends upward from the floor 22. The front and rear walls 26 and 28 are formed at the front and rear opposite ends of the floor 22 and extend upward from the floor 22. The floor 22 and the sidewalls 24 of each track 20, in cooperation, define a channel 30 for receiving a row of articles C. The opposite ends of each channel 30 are defined by the respective front and rear walls 26 and 28.

The floor 22 of each track 20 defines a wide central slot or aperture 23 extending between the front and rear walls 26 and 28 and leaving the sides of the remaining floor portions to define a pair of rails 50, 52 for engaging the respective pusher 70. The slot 23 is wide enough to receive therein the width of the spring 100. The front and rear track walls 26 and 28 (near the forward and back ends, respectively, of the rails 50 and 52) prevent the pusher 70 from coming off of the rails 50 and 52.

The floor 22 of each track 20 preferably includes a plurality of parallel longitudinal support ribs 48, two being illustrated. The ribs 48 extend at least partially between the front and rear walls 26 and 28, and are adapted to be in direct contact with the bottoms of the articles C on the track 20, thereby to reduce the friction between the floor 22 and the articles C.

The front wall 26 of each track 20 is preferably transparent and/or partially cut-away to permit the leading/foremost article C in the respective channel 30 to be visible from the consumer's viewpoint. Depending down from the front wall 26 of each track 20 is an integral anchor stud 38 for the respective spring 100.

In a preferred embodiment, the tracks 20 are molded of a low friction plastic material, for example, a plastic material containing high impact polystyrene and an organopolysiloxane such as dimethylpolysiloxane.

Figure 7:
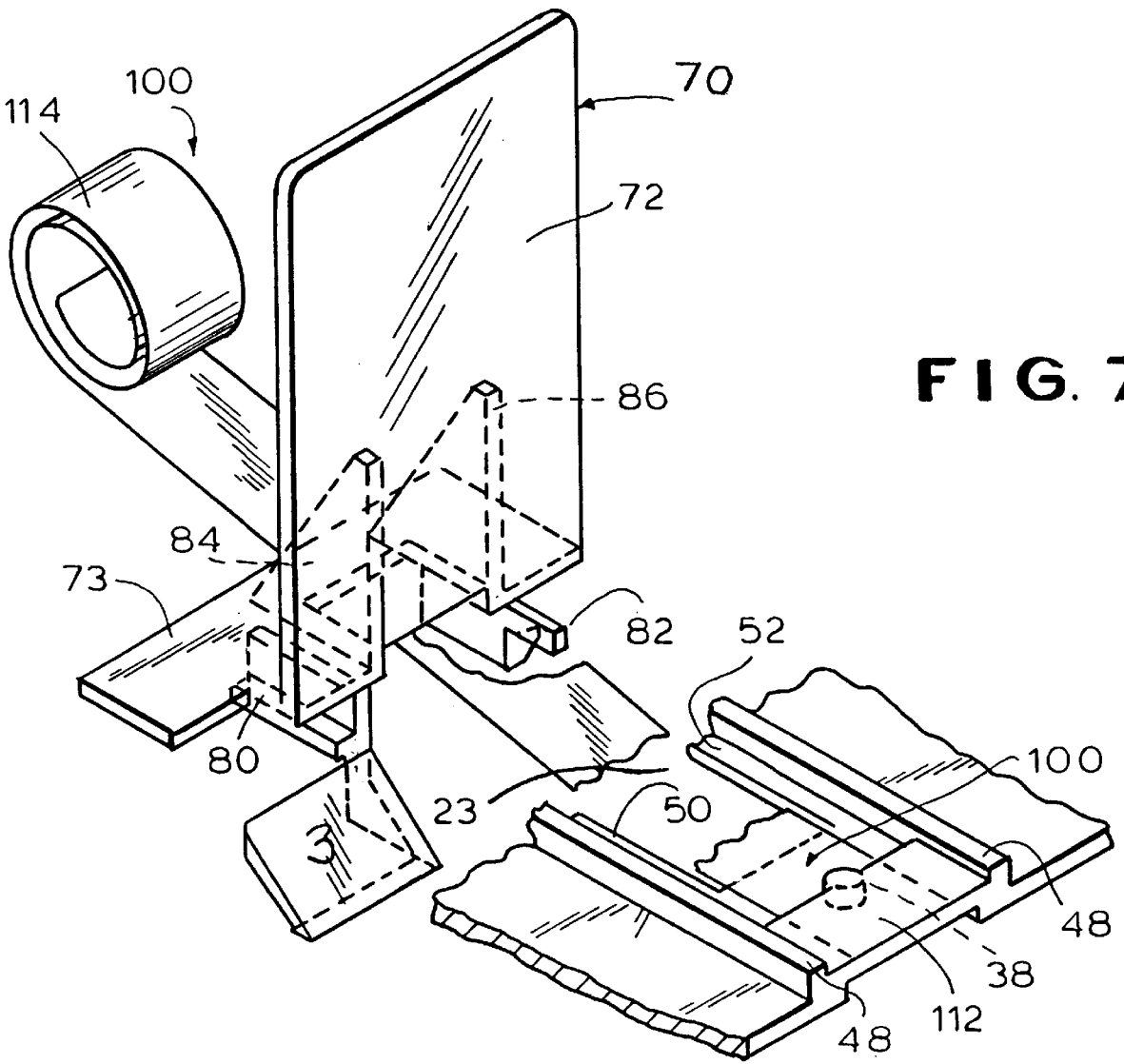
FIG. 7 is an exploded fragmentary isometric view of the spring, pusher and tray of the present invention.

Referring now to FIG. 7 in particular, each pusher 70 comprises an upper member 72, a lower member 74, and a middle member 73 which interconnects the other members 72, 74 for movement as a unit along rails 50, 52 of a track 20. The upper member 72 is of a plate structure connected along its lower edge to the upper edge of middle member 73. The middle member 73 passes through the slot 23 of floor 22 and defines a pair of opposed lateral channels 80 and 82. The channels 80 and 82 receive therein the rails 50 and 52 of the respective track 20 so as to allow the respective pusher 70 to slide along the length of the track 20. The middle member 73 also includes a spring retainer 84 and 86 joined to the rear surface of the middle member 73 and extending backwards therefrom. The lower member 74 is connected along its upper edge to the lower edge of the middle member 73 and will be described in further detail hereinbelow.

Figure 4:
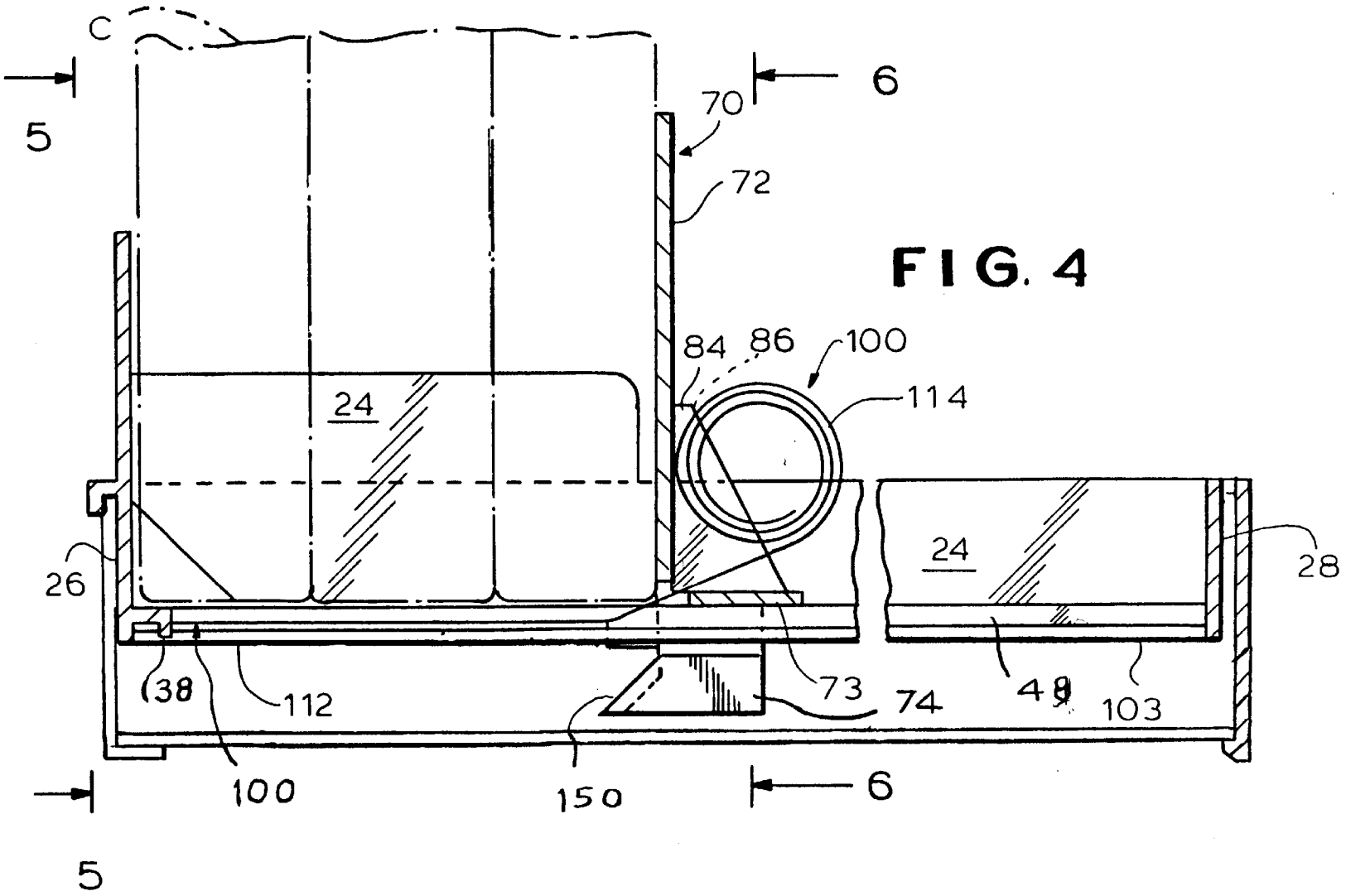
FIG. 4 is a sectional side elevational view taken along the line 4—4 of FIG. 2.
Figure 5:
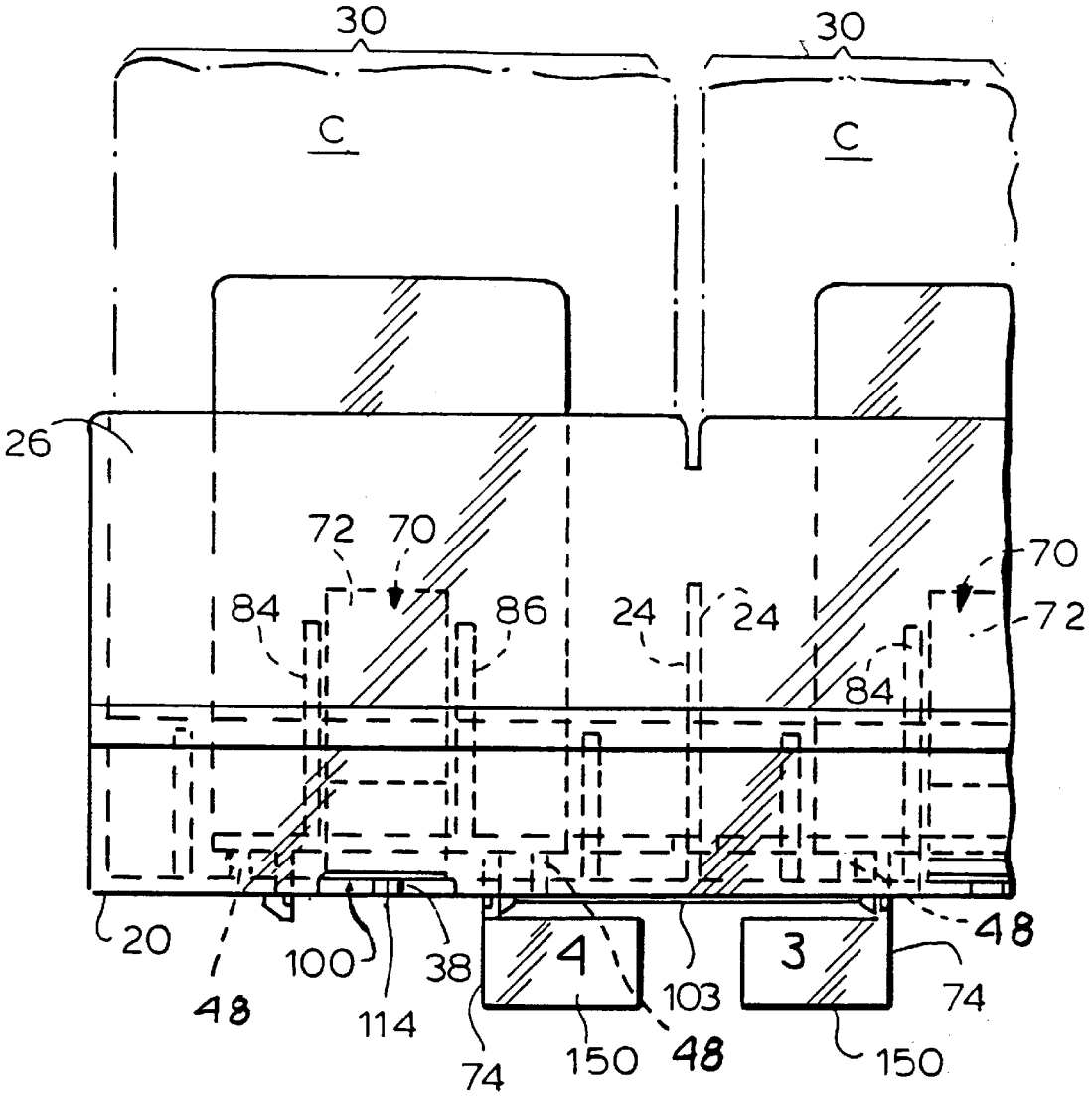
FIG. 5 is a front elevational view taken along the line 5—5 of FIG. 4.
Figure 6:
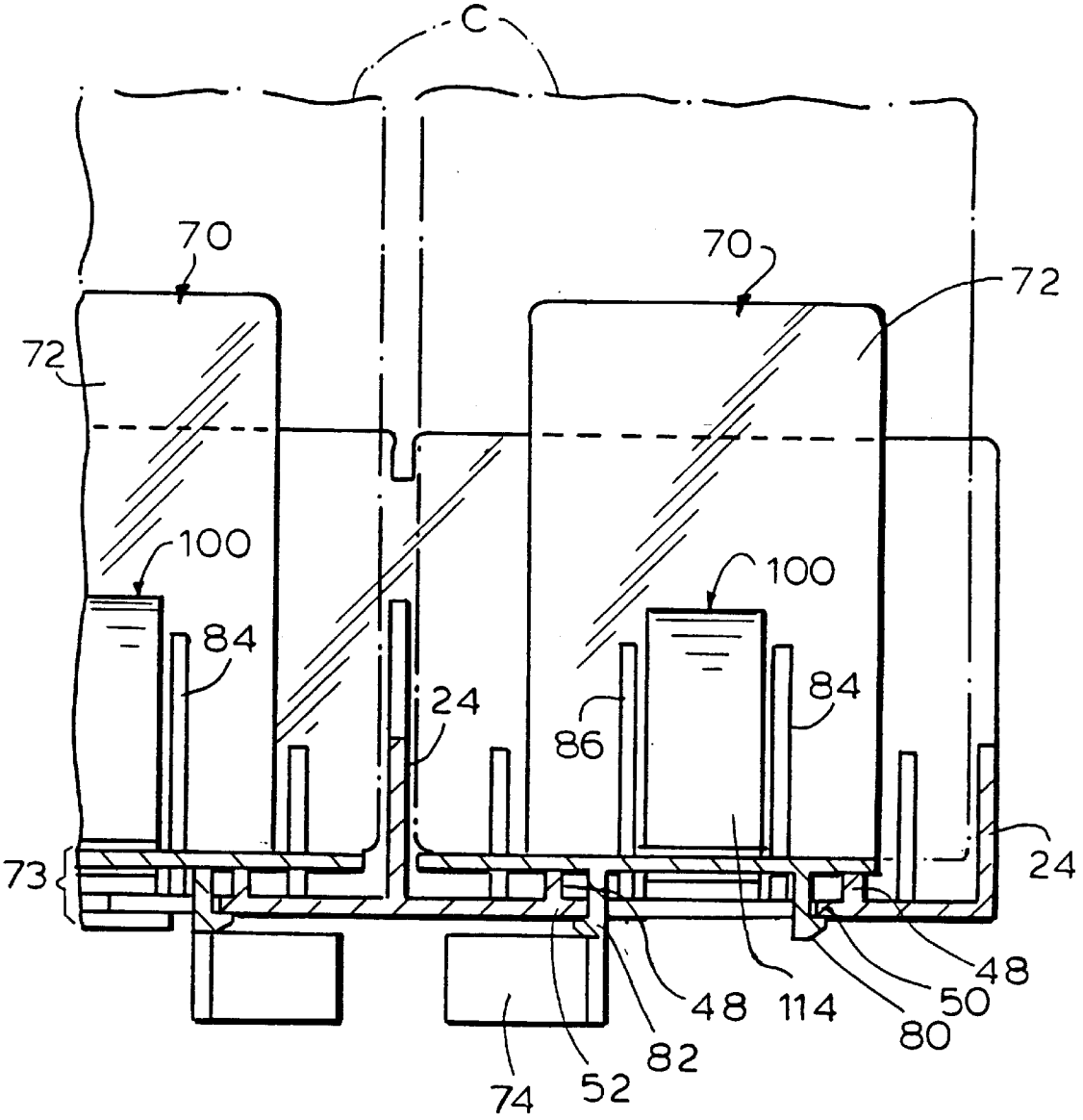
FIG. 6 is sectional rear elevational view taken along the line 6–6 of FIG. 4.

The springs 100 are self-coiling springs, each formed of a strip of spring material. Each spring 100 is secured adjacent its forward end 112 to the respective anchor stud 38 (see FIGS. 4, 5 and 7), extends backward to the location behind the respective pusher 70 and is wound into a coil 114 at the location between the respective spring retainers 84 and 86. The wound/coiled portion 114 of the spring 100 that is located between the retainers 84 and 86 is best shown in FIGS. 4 and 7. As is apparent, when the pusher 70 is at the rearmost position, the spring 100 is most extended and thus forms the coiled portion 114 having a relatively small diameter. On the other hand, as the pusher 70 is moved forward, the extended spring strip is gradually retracted and wound around the coiled portion 114 and thereby the coiled portion 114 is increased in diameter. FIGS. 4 and 7 illustrate the spring 100 with the coiled portion 114 that is formed when the pusher 70 is in an intermediate position along the respective track 20.

In the above arrangement, the spring 100 exerts forwardly directed force on the rear side of the pusher 70 so as to urge the pusher 70 toward the front wall 26. As a result, when positioned between the pusher 70 and the front wall 26, articles C are driven by the pusher 70 to automatically feed toward the front wall 26 as the leading articles successively are removed from the respective track 20 through the front end of the track 20.

The strength of each spring 100 should be such that it exerts sufficient force throughout the range of movement of the respective pusher 70 to move all the articles between the pusher 70 and the respective front wall 26 until the leading/foremost article C on the track 20 reaches the front wall 26. Assuming that each track 20, when fully loaded, accommodates seven articles, the spring 100 should exert sufficient force to move six remaining articles when the leading article is removed from the track 20, to move the five remaining articles when the next leading article is removed, and so on. For this purpose, the spring 100 is preferably a gradient force spring so that the force exerted by the spring 100 gradually reduces as the leading articles are successively removed from the track 20. In other words, the spring 100 is of utility because the articles on the track 20 are prevented from being subject to excessive force. Generally, a gradient force spring when fully extended can exert sufficient force to move more than several heavy-weight articles, such as one-liter beverage bottles, on a low friction plastic track, and yet it can exert less force, just enough force to move a smaller numbers of articles when partially retracted.

The spring 100 may also be a two-stage spring appropriate to prevent excess force from being exerted on the articles C when the respective track 20 is fully loaded. This is due to the two-stage structure having a constant force spring portion and a gradient force spring portion. As described above, because a device designed to accommodate seven articles does not need to move seven articles, but only six, the constant force spring portion of the spring 100 can prevent the spring force exerted by the combined constant and gradient force spring portions from being unnecessarily increased to a magnitude more than adequate to move six articles.

Turning now to the novel aspects of the present invention, a series of numbers 102 may be formed on the plastic of the floor 22, for example, as opaque numbers printed on a transparent floor portion. Alternatively, however, in order to provide greater versatility, the series of numbers 102 may be printed on a separate sheet or strip 103 which is intended to be affixed in a particular orientation on the bottom of the floor portion. Since the reflective panel reflects the numbers 102 from the bottom of the strip 103, it is unnecessary for the floor portion to be transparent.

The strip 103 may be oriented with the numbers 102 in ascending order, extending from the rear 28 to the front 26, so that the number reflecting the position of the pusher 70 indicates the number of articles C which have been removed from the track (assuming that the track was initially filled with articles). Alternatively, the strip 103 may be oriented with the numbers 102 in ascending order, extending from the front 26 to the rear 28, so that the number reflecting the position of the pusher 70 indicates the number of articles C which have been left in the row (a more useful figure for inventory purposes), as illustrated. A single strip 103 may have a series of numbers 102 on one side to indicate the number of articles removed and a series of numbers 102 on the opposite side to indicate the number of articles remaining, thereby providing the retailer with a choice of which series he prefers.

In a preferred embodiment, a variety of strips 103 are provided with a different spacing between the numbers 102 in each series so as to reflect different article thicknesses. Indeed, a given strip 103 may have on one side two series of numbers 102, easily distinguishable from one another (e.g., by color), to reflect the thicknesses of differing articles C which may, at different times, be disposed on the track 20. Thus, one series of numbers 102 may reflect a thin article, while the other set of numbers reflects a thick article.

Regardless of whether the series of numbers 102 is printed on the floor 22 or on a separate strip 103 affixed to the floor 22, each of the numbers 102 is flat and inflexible (at least when the strip 103 is attached to the floor 22). The series of numbers 102 defined by the track 20 lies in a horizontal plane and is preferably disposed on a downwardly facing surface of the floor 22.

While the display tray 10 has been described hereinabove in terms of a separate strip 103 for each track 20, a single wide strip 103 may be used to provide a separate series of numbers 102 for each of a pair of adjacent tracks 20. Further, the series of numbers 102 may be exposed on one or both sides of each slot 23 of a respective track 20.

The aforementioned lower member 74 of pusher 70 extends on at least one side of the slot 23 and defines a reflective panel 150. The reflective panel 150 is substantially rigidly secured to the lower member 74 for travel therewith as a unit. The reflective panel 150 is disposed below the series of numbers 102 (or one of the series of numbers) and extends at an inclination which permits the number 102 reflected by the reflective panel 150 towards at least one end to be read from the front 26 (as shown) or rear 28 of the channel, preferably just below the track floor 22. The reflective panel 150, as a part of the pusher 70, moves along with the upper member 72 and the middle member 73 along the floor 22. However, the reflective panel 150 is disposed below the floor 22 and angled relative to the floor 22 so as to project substantially forwardly or rearwardly (where it may be seen from the channel front 26 or rear 28, respectively, just below the floor 22) the one of the numbers 102 reflecting (i.e., associated with) the position of the pusher 70 along the track 20. The reflective panel 150 optimally forms a 45° angle with the floor 22 or with the horizontal plane defined by the track 20 and including the series of numbers 102. As the floor 22 is substantially rigid and the series of numbers 102 is disposed in a substantially horizontal row, preferably along the bottom of the floor 22 (between the front and rear walls 26, 28 thereof), the reflective panel 150 projects (i.e., reflects) the one number 102 immediately thereabove towards the end 26 or 28 such that the projected one number 102 is easily and clearly visible from the track end 26 or 28.

If desired, the reflective panel 150 may project (i.e., reflect) the one number 102 immediately thereabove rearwardly (i.e., substantially towards the track rear wall 28) such that the projected one number is visible from the track rear end 28 where inventory counting or restocking is to be performed from that rear end 28, forwardly (i.e., substantially towards the track front wall 26), as shown, such that the projected one number is visible from the track front end 26 where inventory counting or restocking is to be performed from that front end 26, or both rearwardly and forwardly, through the use of two oppositely directed reflective panels 150 on the lower member 74.

The reflective panel 150 may simply be a piece of Mylar or other reflective material disposed on a surface of an appropriately angled portion of the lower member 74.

For manufacturing reasons, it is preferred that the one side of the middle member 73 of the pusher 70 opposite the side supporting the reflective panel 150 extends forwardly in the slot 23 further than the side of the middle member 73 of the pusher 70 supporting the reflective panel 150. Thus, when an article C is removed from the channel 30 and the pusher 70 is pushed by the spring 100 against the front wall 26 or the next forward article C, the one or opposite side of the middle member 73 makes contact before the other or panel-bearing side and may, to some degree, shield the other or panel-bearing side from the impact.

In order to enable a relatively free axial movement of the pusher 70 (and in particular the lower member 74 thereof) back and forth along the longitudinal axis of a channel 30 of a display shelf S, there is provided a frame, generally designated 160 and shown (in phantom line) only in FIG. 4. Both lateral frame sides supports the bottom of at least one display tray 10 (including the bottom of the lower member 74 thereof) above the shelf S supporting the frame 160. To this end, appropriate hook-like portions 162 may be disposed on the front and rear of the display tray 10 to enable releasable mounting of the display tray 10 on the frame 160.

To summarize, the present invention provides in an article pusher display tray an inventory counting system wherein the number of articles on or removed from a track is evidenced at all times, without requiring any manual operation on the system by a user. The markings are disposed flat on a rigid surface and may be easily read from one end of the track along a generally horizontal line of sight. The present invention is inexpensive and simple to manufacture, use and maintain.

Now that the preferred embodiments of the present invention have been shown and described in detail, various modifications and improvements thereon will become readily apparent to those skilled in the art. Accordingly, the spirit and scope of the present invention is to be construed broadly and limited only by the appended claims, and not by the foregoing specification.

We claim:

1. An inventory counting article pusher display tray system comprising:

(A) an elongate track having a front end and a rear wall and including a floor for positioning a row of articles thereon for movement along said track, said track further defining a series of longitudinally spaced numbers extending rearwardly from said track front end for indicating the number of articles in or removed from the row;

(B) a pusher connected to said track for movement therealong and having a front side for engagement with a rearmost article on said track;

(C) spring means for urging said pusher toward said track front end so as to move all articles on said track toward said track front end; and (D) a reflective panel secured to said pusher for movement as a unit along said floor, said reflective panel being disposed below said floor and angled relative to said floor so as to project substantially towards one of said track front end and said track rear wall one of said numbers reflecting the position of said pusher along said track.

2. The device of claim 1 wherein said spring means is a self-coiling spring comprising a strip of spring material wound at least partially to form a coiled portion defining a coil axis, said coiled portion being arranged such that said coiled portion is extended as said pusher is moved toward said track rear end.

3. The device of claim 1 wherein each of said numbers defined by said track is flat and inflexible.

4. The device of claim 1 wherein said series of numbers defined by said track lies in a horizontal plane, and said reflective panel forms a 45° angle with said plane and projects said one number substantially forwardly towards said track front end.

5. The device of claim 1 wherein said series of numbers defined by said track is disposed on a downwardly facing surface of said floor.

6. The device of claim 1 wherein said floor has a transparent portion wherein said series of numbers are opaque and disposed on said transparent portion at regular longitudinal intervals corresponding to the thickness of an article sequentially in ascending order from said track front end to said track rear wall such that said projected one number indicates the number of articles remaining on said track and is visible from above said track.

7. The device of claim 1 wherein said reflective panel projects the one number immediately thereabove forwardly such that said projected one number is visible from said track front end.

8. The device of claim 1 wherein said series of numbers run sequentially in ascending order from said track front end to said track rear wall such that said projected one number indicates the number of articles remaining on said track.

9. The device of claim 1 wherein said series of numbers run sequentially in ascending order from said track front end to said track rear wall such that said projected one number indicates the number of articles removed from said track.

10. The system of claim 1 wherein said floor is substantially rigid, and said series of numbers is disposed in a substantially longitudinal row along a bottom of said floor.

11. The device of claim 1 wherein said reflective panel is substantially rigidly secured to said pusher for travel therewith as a unit.

12. An inventory counting article pusher display tray system comprising:

(A) an elongate track having a front end and a rear wall and including a floor for positioning a row of articles thereon for movement along said track, said track further defining a series of longitudinally spaced numbers extending rearwardly from said front end for indicating the number of articles in or removed from the row; each of said numbers being flat and inflexible, said series of numbers lying in a horizontal plane and being disposed on a downwardly facing surface of said floor;

(B) a pusher connected to said track for movement therealong and having a front side for engagement with a rearmost article on said track;

(C) spring means for urging said pusher toward said front end of said track so as to move all articles on said track toward said track front end, said spring means being a self-coiling spring for urging said pusher toward said track front end, said spring comprising a strip of spring material wound at least partially to form a coiled portion defining a coil axis, said coiled portion being arranged such that said coiled portion is extended as said pusher is moved toward said track rear end;

(D) a reflective panel secured to said pusher for movement as a unit along said floor, said reflective panel being disposed below said floor and angled relative to said floor at about 45° so as to project substantially forwardly one of said numbers corresponding to the position of said pusher along said track; said reflective panel projecting the one number immediately thereabove forwardly such that said one number is visible from said track front end.

13. The device of claim 12 wherein said floor has a substantially rigid transparent portion wherein said series of numbers are opaque and disposed on said transparent portion at regular longitudinal intervals corresponding to the thickness of an article and running sequentially between said track front end and said track rear wall in a substantially horizontal row such that said projected one number indicates the number of articles remaining on or removed from said track and is visible from above said track.

* * * * *